United States Patent [19]

Kondo et al.

[11] Patent Number: 4,899,657

[45] Date of Patent: Feb. 13, 1990

[54] METHOD FOR PREVENTING PENETRATION OF DAMPING SOLUTION BETWEEN SUPPORTING BASE AND PLATE

[75] Inventors: Toshiro Kondo; Eiji Kanada; Kyonosuke Yamamoto, all of Nagaokakyo, Japan

[73] Assignee: Mitsubishi Paper Mills, Ltd., Tokyo, Japan

[21] Appl. No.: 140,561

[22] Filed: Jan. 4, 1988

[30] Foreign Application Priority Data

Jan. 12, 1987 [JP] Japan ..... 62-5764
Feb. 10, 1987 [JP] Japan ..... 62-19288[U]
Feb. 13, 1987 [JP] Japan ..... 62-30737

[51] Int. Cl.[4] ..... B41F 7/20
[52] U.S. Cl. ..... 101/451
[58] Field of Search ..... 101/415.1, 450.1, 451

[56] References Cited

U.S. PATENT DOCUMENTS 427,366 5/1890 Robischung ..... 101/415.1
2,267,646 12/1941 Gorig ..... 101/401.1
2,421,825 6/1947 Aulick ..... 101/127
3,055,337 9/1962 Cossaboon ..... 101/415.1
3,126,825 3/1964 Tofano ..... 101/415.1
3,162,116 12/1964 Weber ..... 101/128.1
3,358,598 12/1967 Middleton ..... 101/415.1
3,696,745 10/1972 Morton ..... 101/415.1
3,930,852 1/1976 Tanaka ..... 101/415.1
4,648,318 3/1987 Fischer ..... 101/415.1

FOREIGN PATENT DOCUMENTS 373316 4/1923 Fed. Rep. of Germany ... 101/415.1

*Primary Examiner*—Clifford D. Crowder
*Attorney, Agent, or Firm*—Cushman, Darby & Cushman

[57] ABSTRACT

A method for lithographic printing of paginal publications which comprises applying onto a flexible supporting base two or more lithographic printing plates arranged in the rotational direction of a master cylinder and to form such a structure with front and rear edge portions of the adjacent lithographic printing plates as to prevent penetration of damping solution between the supporting base and the lithographic printing plates, the portion of said structure receiving substantially no ink. This supporting base is mounted on a master cylinder of a printing machine and printing is carried out.

18 Claims, 2 Drawing Sheets

METHOD FOR PREVENTING PENETRATION OF DAMPING SOLUTION BETWEEN SUPPORTING BASE AND PLATE

BACKGROUND OF THE INVENTION

The present invention relates to a method for lithographic printing and more particularly, it relates to a method for printing of books, magazines and the like, namely, so-called paginal publications.

Lithographic printing is performed by feeding both a coloring ink and water on the surface of a printing plate to have the coloring ink and the water selectively received by image area and non-image area, respectively and transfering the ink on the image area to a substrate such as a paper. Therefore, in order to obtain excellent printed matters, it is necessary that oleophilic activity of the image area and hydrophilc activity of the non-image area are both strong enough so that when water and ink are applied the image area can receive sufficient amount of ink while the non-image area can completely repel the ink.

As lithographic printing plates used at present, there are, for example, presensitized plates (PS plate) having a support of metals such as aluminum, printing plates obtained by electrophotography (e.g., electrofax), so-called master papers which comprise a paper base coated with a pigment together with a binder on the surface, photolithographic materials using silver salts disclosed in Japanese Patent Examined Publication (Kokoku) No. 30562/73, etc.

It is well known for printing of books, magazines, catalogues, newspapers which are to be bound to apply a plurality of printing plates to a printing machine. Light-sensitive lithographic printing plates for so-called direct plate making which have high sensitivity to various laser beams, such as silver salt type lithographic printing plates and electrophotographic printing plates have been increasingly demanded for use in printing of paginal publications because they can be used for plate making which utilizes computers. In the case of laser direct plate making methods, it is not only impossible to print many pages in one light-sensitive lithographic printing plate of large size according to the present output devices, but also difficult to print in a composition convenient for binding the pages into a book. Therefore, lithographic printing plates recorded thereon with information of respective pages must be separately made and combined. In the case of direct lithographic printing plates of process camera type, if the process camera is of small size, respective lithographic printing plates must also be combined. However, hitherto, printing of paginal publications by a large size printing machine by combining lithographic printing plates of small size has not been effected. The reason therefor is that when a plurality of lithographic printing plates are mounted and arranged in the direction of revolution of the master cylinder in such a manner that a tail edge of a first printing plate (the head edge of which is fixed to the master cylinder by a clamp or the like) and a head edge of a second printing plate and in some case, a tail edge of the second printing plate and a head edge of a third printing plate and so on are respectively connected, for example, by application of cellophane tape to backside thereof and printing of several thousands copies is carried out using these printing plates arranged in succession, there occur such severe problems as peeling-off of the second and the following printing plates, retention of ink between the printing plates and damage of blanket to make the subsequent printing impossible.

As a result of the inventors' intensive research in an attempt to solve the above problems, a printing method of paginal publications which satisfies the above demands and which has never been realized has been found.

SUMMARY OF THE INVENTION

An object of the present invention is to provide a printing method which makes it possible to print a paginal publication by applying a plurality of lithographic printing plates in the revolving direction of the cylinder.

Another object of the present invention is to provide a printing method which makes it possible to print a paginal publication by a machine by combination of lithographic printing plates of small size.

Other objects and advantages of the present invention will be apparent from the following description.

DESCRIPTION OF THE INVENTION

The above objects have been accomplished by a lithographic printing method which comprises applying two or more lithographic master plates arranged in the rotational direction of a master cylinder onto a flexible supporting base and mounting this base on a master cylinder of a printing machine wherein the lithographic printing plates are arranged and applied to the flexible supporting base to form such a structure with front and rear edge portions on the lithographic printing plates as to prevent penetration of damping solution between the supporting base and the lithographic printing plates from a gap between front and rear edge portions of the lithographic printing plates, the portion of said structure receiving substantially no ink.

The present invention will be explained in detail with reference to the drawings.

Figure 1:
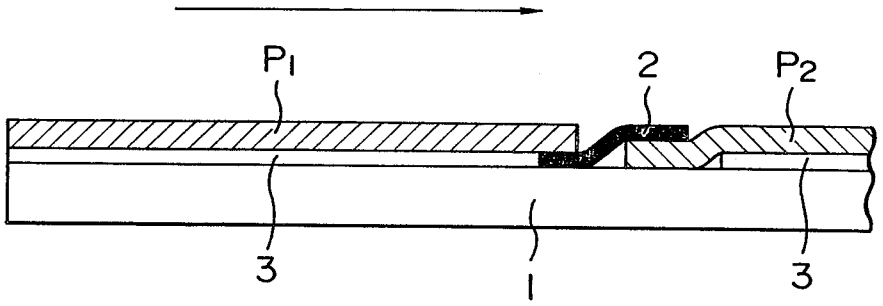
FIGS. 1–3 are side views which diagrammatically show the state of lithographic printing plates arranged on a support before application onto a master cylinder and FIG. 4 is a top view of FIGS. 1 and 2.
Figure 2:
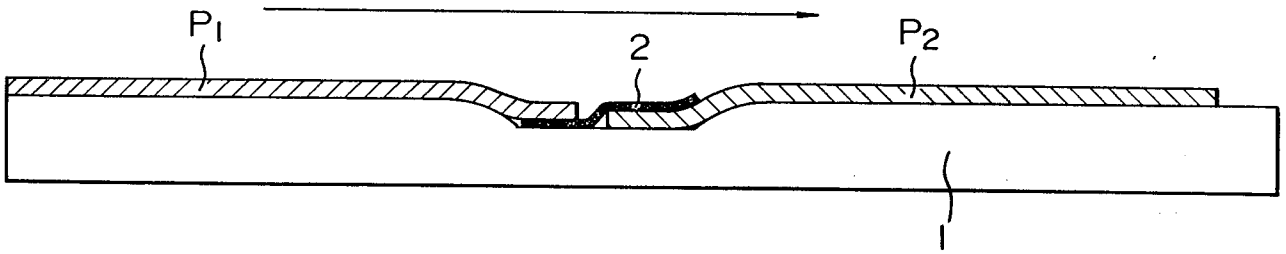
Figure 3:
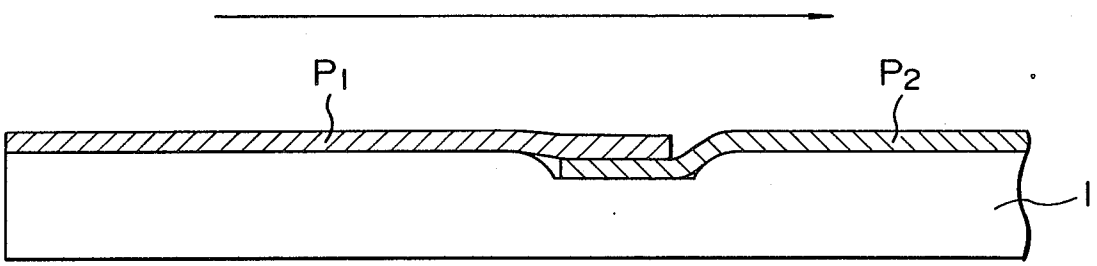
Figure 4:
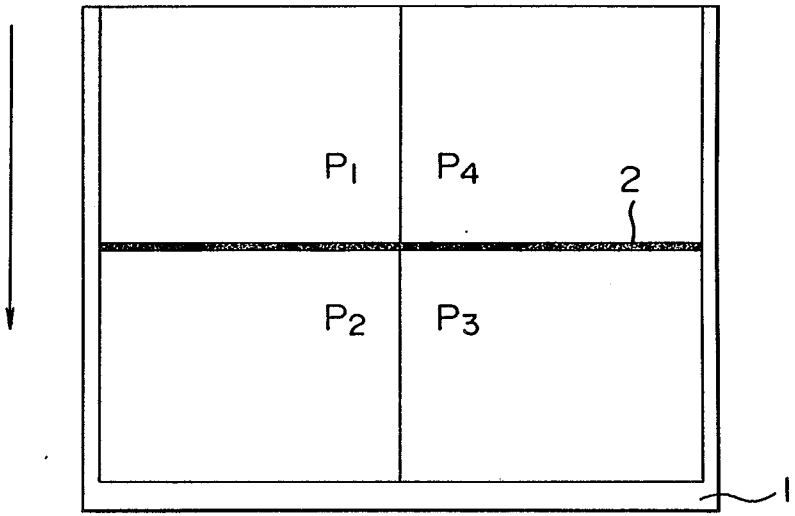

FIGS. 1–3 show representative examples of the present invention and are side views which diagrammatically show the state of arrangement of lithographic printing plates applied onto a supporting base before being mounted on the master cylinder of a printing machine and FIG. 4 is a top view which shows the state of lithographic printing plates (4 plates) for four pages applied in accordance with the methods as shown in FIGS. 1 and 2. They are shown exaggerated in order to accelerate understanding of the invention.

In these Figures, 1 indicates a flexible supporting base which may be made of any materials as long as it has such flexibility as capable of being mounted on the master cylinder with supporting the lithographic printing plates $P_1$, $P_2$, – $P_n$. For example, metallic sheets such as aluminum and iron, plastic sheets such as polyester, polyethylene, polystyrene and polycarbonate and composite sheets thereof may be used as the supporting base.

Thickness of the flexible supporting base is determined considering the thickness of the lithographic printing plates and printing pressure, but generally is selected from the range of about 50 μm – about 700 μm.

Lithographic printing plates $P_1$, $P_2$, $P_3$ and $P_4$ are subjected to exposure to originals of page 1, page 2, page 3 and page 4, respectively and then to plate making treatments such as development and the like. These are arranged as shown in FIG. 4. The arrows in the Figures indicate the direction of rotation of the master cylinder. $P_1$ and $P_4$ and $P_2$ and $P_3$ are arranged so that the upper sides of originals contact with each other, respectively. Reference number 2 indicates a back side-adhesive thin film the upper surface of which is highly hydrophilic so as to receive substantially no printing ink during printing. The adhesive on the back side may be previously provided as an adhesive layer or may be provided by coating an adhesive or applying double adhesive surface tape just before use. The back side of this thin film 2 adheres to flexible support base 1 and lithographic printing plate $P_2$. Another side (top side) of thin film 2 can be rendered ink non-receptive by giving hydrophilicity equal to or more than that of non-image area of lithographic printing plate. Such hydrophilicity can be imparted thereto by a method of coating thereon the same composition as of printing layer of the lithographic printing plate, a method of coating thereon a hydrophilic composition (for example, a hydrophilic polymer solution containing colloidal silica at high concentration), a method of surface modification of the thin film. An especially effective method is to hydrolyze with an alkali the surface of plastic substrates such as cellulose acetate, cellulose acetate butyrate, cellulose propionate, etc., disclosed, for example, in Japanese Patent Unexamined Publication (Kokai) Nos. 76434/81 and 36131/82.

Thickness of thin film 2 is preferably as thin as possible and generally is 10 μm – 200 μm. Thin film 2 is not limited to film, but may be of other materials, for example, metals such as an aluminum foil.

It is preferred that at least one of lithographic printing plate $P_1$ and thin film 2 is coated with adhesive and they are allowed to adhere, but they may not necessarily be allowed to adhere to each other. Further, if the back side adhesive layer of thin film 2 is high in water resistance, printing plate $P_1$ need not be superposed and may be separated from thin film 2.

3 indicates a under sheet film which adjusts the thickness of thin film 2 to make uniform the thickness of printing plates $P_1$ and $P_2$ and thin film 2, thereby to apply uniform printing pressure by blanket. However, this under sheet film may be omitted in some case. Thickness of the under sheet film may be equal to or a little thicker than that of thin film 2. Material of the under sheet film is not limited to film. This under sheet is preferably allowed to adhere to flexible supporting base 1 with an adhesive and further allowed to adhere to printing plates $P_1$, $P_2$, – $P_n$ with an adhesive. When thickness, size and number of the lithographic printing plates are fixed, it is much preferred for operation to use flexible supporting base 1 and under sheet film 3 which are integrally molded with plastics and the like in a mold. That is, it is especially preferred to use a flexible resin plate (indicated by 1 in FIGS. 2 and 3) provided with a groove or grooves of a width in which end portions of adjacent lithographic printing plates can be connected.

Resin plate 1 may be of flexible resins capable of being mounted on a master cylinder, such as polystyrene, polyvinyl chloride, acryl, alkyd, phenol, silicone, urea, melamine and fluoro resins. Thickness of resin plate 1 may vary depending on the kind of printing machine and thickness of the printing plates, but preferably is about 200 μm – about 700 μm.

Preferably, side walls of the groove of resin plate 1 are inclined as shown in FIGS. 2 and 3. This is because sticking of ink to edge portions of printing plate $P_1$ (and thin film) when mounted on master cylinder can be prevented. The inclined wall need not have any roundness, but may be stepwise. Width of the groove of resin plate 1 is preferably about 5 mm – about 10 mm.

Spacing between $P_1$ and $P_2$ in FIGS. 1 and 2 is preferably narrower, for example, may be about 0.1 cm – about 3 cm. Length of adhering of thin film 2 to printing plate $P_2$ is suitably about 0.5 cm – about 3 cm which gives an adhesion area enough not to cause peeling-off of printing plate $P_2$ during printing.

The thickness from the surface of flexible supporting base 1 until the surface of the printing plate is preferably less than about 250 μm. If more than 250 μm, when mounted on a master cylinder, edge of printing plate $P_1$ is warped to often cause breakage of the printing plate or damage to the blanket.

The relation of printing plates $P_1$ and $P_2$ may also be applied to the relation of printing plates $P_4$ and $P_3$ in FIG. 4.

In FIGS. 1 and 4 where printing plates $P_1$ to $P_4$ are arranged for as shown, front edges (left end in FIG. 1) of the first printing plates $P_1$ and $P_4$ are clamped by master cylinder and similarly, rear edges (right end in FIG. 1, not shown) of the second printing plates $P_2$ and $P_3$ are clamped by the master cylinder and the master cylinder is rotated in the direction of the arrow to start printing.

Damping solution flows in the same direction as rotation of master cylinder (arrow), but since thin film 2 is provided in such a construction as shown in FIGS. 1 and 2, the damping solution does not penetrate between the end of the second printing plates $P_2$ and $P_3$ and flexible supporting base 1 and besides, the surface of thin film 2 has a high hydrophilicity, substantially no ink sticks to the portion of said construction except that a slight amount of ink sticks to rear edge portions of printing plates $P_1$ and $P_4$ and edge portion of thin film 2 to result in unnecessary printing of two lines.

FIG. 3 shows another further preferable embodiment of the present invention wherein the rear edge portion of lithographic printing plate $P_1$ is superposed on the front edge portion of lithographic printing plate $P_2$ and, if necessary, the portions are pasted to each other with adhesives, etc. without using thin film 2. In the embodiment of FIG. 3, rear edge portion of printing plate $P_1$ over the front edge of $P_2$ has the same function as thin film 2 in FIG. 2.

Printed copies obtained in the state as shown in FIG. 4 are folded in the order of pages and the edge portions on which unnecessary lines might be printed are cut off to obtain a paginal printed publication.

Such problem of ink sticking to the adjacent edge portions of lithographic printing plates in this printing method can be solved by making ink non-receptive the portion of blanket or inking form roller corresponding to the ink sticking portion of the edge portions at the time of application of damping solution.

That is, in the example of FIG. 1, an ink non-receptive portion having a width somewhat wider than the width between the rear edge portion of printing plate $P_1$ ($P_4$) and the edge portion of thin film 2 and an ink non-receptive portion having a width wider than the width between the adjacent edge portions of printing plates $P_1$ and $P_4$ and $P_2$ and $P_3$ are provided on the corresponding blanket, respectively. Only one of the former ink non-receptive portion or the latter ink non-receptive portion may be provided and when both are provided, they may be provided on blanket and inking form roller separately.

The most preferred method for providing the ink non-receptive portions is to apply to blanket or inking form roller a hydrophilic film the surface of which has been subjected to hydrolysis treatment as mentioned on thin film 2 of FIG. 1. However, even if the ink non-receptive portion has such very high hydrophilicity, ink for lithographic printing plate which uses damping solution is apt to stick to the non-receptive portion before wetting with damping solution. Therefore, it is preferred to wet the surface of film with a damping solution (which may be water alone) before starting of printing.

The ink non-receptive portion may also be provided by using a thin film having a high concentration colloidal silica coating layer previously mentioned besides the surface modified film. Further, when blanket or inking form roller to be used exclusively for this printing method are used, the corresponding portion thereof may be hydrophilized, for example, by coating of a hydrophilic material, modification of the surface or bonding of a thin film as mentioned above.

When printing is conducted by repeatedly using printing plates, the above mentioned procedure can also be followed.

The method of the present invention is not critical in the kind of lithographic printing plates used and can employ various lithographic printing plates as previously mentioned. The damping solution may be any of known ones and may be water.

According to the present invention, printing of a paginal publication comprising many pages can be performed without damaging the blanket by applying two or more lithographic printing plates in the direction of rotation of master cylinder.

Furthermore, when printing of a paginal publication is carried out by a larger printing machine, printing plates can be made by a small process camera and thus this is a remarkable advantage for users.

EXAMPLE 1

Originals of A3 size were output to laser direct lithographic printing plates (trade name: SDP-RH manufactured by Mitsubishi Paper Mills, Ltd.) which utilized a silver complex diffusion transfer process by helium-neon laser output device to make the plates. These printing plates SDP-RH were applied onto a resin plate (550 μm thick) provided with a groove of 8 mm in width and 200 μm in depth as shown in FIGS. 2 and 4. Bordon Film (trade name for product of Toyo Kako Co.) was used as thin film 2. The thus prepared lithographic printing plates were mounted on an offset printing machine (trade name: Heidel SORS of Heidelberg Co., maximum printed size 690×1020 mm) and 5,000 copies were printed using etching solution and damping solution to be exclusively used for SDP-RH. No damage to the printing plates or the blanket occurred.

EXAMPLE 2

Example 1 was repeated using the method as shown in FIGS. 3 and 4 and obtained the same results as in Example 1.

EXAMPLE 3

Printing plates were made using zinc oxide master papers by a process camera of A3 size. Using the printing plates for four pages arranged for in accordance with Example 1, printing was carried out with the printing machine used in Example 1 and etching solution and damping solution which are for exclusive use therefor. No trouble occurred even after printing of 3000 copies.

The resin plate 1 used in Examples 1, 2 and 3 did not deform even after repeated use of many times and superior in operability.

EXAMPLE 4

Under sheet film (polyester) 3 was applied onto aluminum plate 1 as shown in FIG. 1 and SDP-RH corresponding to page 2 and page 3 were applied as shown in FIGS. 1 and 4.

Thin film 2 (Bodon Film of Toyo Kako Co.) was applied to the end portions of these two printing plates as shown in FIGS. 1 and 4 and subsequently, SDP-RH corresponding to page 1 and page 4 were applied as shown in FIGS. 1 and 4. Lithographic printing plates thus arranged for were mounted on an offset printing machine (Heidel SORS of Heidelberg Co.) and printing of 5,000 copies was carried out using etching solution and damping solution exclusively used for SDP-RH and caused no damage of the printing plates or blanket.

EXAMPLE 5

Printed copies obtained in Example 1 had linear sticking of ink in lengthwise and breadthwise directions between printing plates.

Bordon film was applied to the portion of blanket of said printing machine which corresponded to the portion of linear printing and before starting of printing, this Bordon film was wetted with said damping solution and then printing was carried out. Even after printing of 5,000 copies, the linear printed lines were not caused and no damage of printing plates or blanket occurred.

What is claimed is:

1. A method for lithographic printing which comprises arranging and applying two or more lithographic printing plates, adjacent to one another and in the rotational direction of a master cylinder of a printing machine, onto a flexible supporting resin base,;

said resin base having a groove or grooves in which said adjacent printing plates are connected with one another to form a connected structure;

said connected structure being formed by connecting with a hydrophilic thin film sheet a bottom and a rear edge portion of a first adjacent printing plate with a top and a front edge portion of a second adjacent printing plate;

additional adjacent printing plates can be added to said connected structure with a hydrophilic thin film sheet in the following manner, connecting a bottom and a rear edge portion of said second adjacent printing plate with a top and a front edge portion of a third adjacent printing plate;

said connected structure preventing penetration of a damping solution and a printing ink between said resin base and said adjacent lithographic printing plates, said front and said rear edge portions of said printing plates receiving substantially no ink.

2. A method according to claim 1 wherein the thickness of the supporting base is about 50 μm – about 700 μm.

3. A method according to claim 1 wherein the thickness of said resin base is about 200 μm – about 700 μm.

4. A method according to claim 1 wherein the surface of the thin film is hydrolyzed to render it hydrophilic.

5. A method according to claim 1, wherein the thickness from a top surface of said supporting base to a bottom surface of said printing plate is about 250 μm or less.

6. A method according to claim 1 which prints a paginal publication.

7. A method according to claim 6 wherein the printing plates are made by exposure to laser beams.

8. A method according to claim 1, wherein said hydrophilic thin film is further applied to a blanket and/or inking form roller to make a portion of said blanket and/or inking form roller non-ink receptive.

9. A method according to claim 1, wherein said groove comprises side walls, said side walls being inclined.

10. A method for lithographic printing which comprises arranging and applying two or more lithographic printing plates, adjacent to one another and in the rotational direction of a master cylinder of a printing machine, onto a flexible supporting resin base and carrying out printing;

said resin base having a groove or grooves in which said adjacent printing plates are attached to one another to form a connected structure;

said connected structure being formed by attaching a bottom and a rear edge portion of a first adjacent printing plate to a top and a front edge portion of a second adjacent printing plate, said bottom and said rear edge portion of said first printing plate being superimposed on said top and said front edge portion of said second printing plate;

additional adjacent printing plates can be added to said connected structure in the following manner, attaching a bottom and a rear edge portion of said second adjacent printing plate to a top and a front edge portion of a third adjacent printing plate, said bottom and said rear edge portion of said second printing plate being superposed on a top and a front edge portion of a third adjacent printing plate;

said connected structure preventing penetration of a damping solution and a printing ink between said resin base and said adjacent lithographic printing plates.

11. A method according to claim 10, wherein the thickness of said supporting base is about 50 μm – 700 μm.

12. A method according to claim 10, wherein the thickness of said resin base is about 200 μm – 7000 μm.

13. A method according to claim 10, wherein said connected structure is such that said bottom and said rear edge portion of said first printing plate and said top and said front edge portion of said second printing plate are connected by a hydrophilic thin film sheet.

14. A method according to claim 13, wherein the surface of said thin film is hydrolyzed to render it hydrophilic.

15. A method according to claim 13, wherein said hydrophilic thin film is further applied to a blanket and/or inking form roller to make a portion of said blanket and/or inking form roller non-ink receptive.

16. A method according to claim 3, wherein the thickness from a top surface of said supporting base to a bottom surface of said printing plate is about 250 μm or less.

17. A method according to claim 3, which prints a paginal publication.

18. A method according to claim 17, wherein the printing plates are made by exposure to laser beams.

* * * * *